US010555643B1

(12) United States Patent
Lu et al.

(10) Patent No.: US 10,555,643 B1
(45) Date of Patent: Feb. 11, 2020

(54) HUMANIZED CONTROL DEVICE APPLIED TO HEALTH SHOWER DEVICE

(71) Applicant: XIAMEN EASO CO., LTD., Xiamen, Fujian (CN)

(72) Inventors: Haitao Lu, Xiamen (CN); Yuebin Yang, Xiamen (CN); Zhen Li, Xiamen (CN); Ximin Chen, Xiamen (CN)

(73) Assignee: XIAMEN EASO CO., LTD., Xiamen, Fujian (CN)

( * ) Notice: Subject to any disclaimer, the term of this patent is extended or adjusted under 35 U.S.C. 154(b) by 0 days.

(21) Appl. No.: 16/147,893

(22) Filed: Oct. 1, 2018

(51) Int. Cl.
*A47K 3/28* (2006.01)

(52) U.S. Cl.
CPC ..... *A47K 3/28* (2013.01)

(58) Field of Classification Search
CPC ..... A47K 3/28
USPC ..... 4/612
See application file for complete search history.

(56) References Cited

U.S. PATENT DOCUMENTS 4,934,001 A * 6/1990 Landreth ..... A47K 3/285 4/615
5,277,454 A * 1/1994 Lorch ..... E03C 1/0401 239/587.1
5,937,451 A * 8/1999 Mihara ..... E03D 9/085 239/583
7,458,112 B1 * 12/2008 Yang ..... E03C 1/0408 137/625.47
2006/0218721 A1 * 10/2006 Ho ..... A61H 33/6036 4/615
2017/0002553 A1 * 1/2017 Huang ..... E03C 1/0408

* cited by examiner

*Primary Examiner* — Jeremy Carroll
(74) *Attorney, Agent, or Firm* — Chun-Ming Shih

(57) ABSTRACT

A humanized control device applied to a health shower device includes a shower rod, a water diverter, and an operating mechanism. The water diverter is connected to the upper end of the shower rod. The operating mechanism is connected to the lower end of the shower rod. The operating mechanism is linked with a valve core of the water diverter through a linking member located in the shower rod. The operating mechanism can control the water diverter to switch the waterway. It is convenient for users of different heights to switch different spray modes.

13 Claims, 5 Drawing Sheets

HUMANIZED CONTROL DEVICE APPLIED TO HEALTH SHOWER DEVICE

BACKGROUND OF THE INVENTION

1. Field of the Invention

The present invention relates to a bathroom accessory, and more particularly to a humanized control device applied to a health shower device.

2. Description of the Prior Art

In general, a conventional household shower device includes a shower nozzle and a hand-held show head. Through a water diverter disposed at the water outlet of a water supply pipe, the shower nozzle and the hand-held show head are selective to spray water.

For the families in the Americas, the water outlet of the water supply pipe is located at the upper part of the wall. The wall is provided with a shower rod communicating with the water outlet of the water supply pipe as a water passage for the shower nozzle or the hand-held show head to spray water. The upper part of the shower rod is connected to the water outlet of the water supply pipe. The shower rod is provided with an adjustable bracket to retain the hand-held shower head for adjusting the height of the hand-held shower head to be retained. In general, the water diverter used for switching the waterway of the shower nozzle and the waterway of the hand-held shower head is disposed in the shower rod at a position corresponding to the water outlet of the water supply pipe. It is inconvenient for a user or child whose height is not tall enough to operate the water diverter, and there are limitations in use. Accordingly, the inventor of the present invention has devoted himself based on his many years of practical experiences to solve these problems.

SUMMARY OF THE INVENTION

The primary object of the present invention is to provide a humanized control device applied to a health shower device, which is suitable for a wall-mounted shower device and can facilitate users of different heights to switch spray modes.

In order to achieve the above object, the present invention adopts the following technical solutions.

A humanized control device applied to a health shower device comprises a shower rod, a water diverter, and an operating mechanism. The water diverter includes a three-way body and a valve core. The three-way body has a lateral inlet, an upper outlet, and a lower outlet. The valve core is movably fitted in the three way body to block the upper outlet and the lower outlet. The shower rod is a hollow structure. An upper end of the shower rod is connected to the lower outlet of the three way body. The operating mechanism includes a three-way member and an operating lever. The three-way member has an inlet end opening, an outlet end opening, and a mounting end opening. The operating lever is movably disposed in the mounting end opening. The inlet end opening is connected to a lower end of the shower rod. Two ends of the operating lever are a linking end and an operating end, respectively. The linking end of the operating lever is linked with the valve core through a linking member located in the shower rod.

Preferably, the mounting end opening is provided with a sliding sleeve therein. The sliding sleeve has a central through hole. The operating lever is movably inserted in the through hole.

Preferably, a side wall of the sliding sleeve is formed with a first positioning groove having a closed annular shape and a heart-shaped structure. The first positioning groove has a recessed portion and a pointed portion. The operating lever is sleeved with a locking sleeve. The locking sleeve is mated with a first positioning member. An end of the first positioning member abuts against a bottom surface of the first positioning groove. The end of the first positioning member is movably engaged with the recessed portion and the pointed portion of the first positioning groove.

Preferably, the pointed portion of the first positioning groove is close to the operating end of the operating lever. The locking sleeve is fixed on the operating end of the operating lever. The operating end of the operating lever is connected with a button.

Preferably, the first positioning member is an elastic rib. Two ends of the elastic rib are bent to form bent portions. The bent portion of one end of the elastic rib abuts against the bottom surface of the first positioning groove and is movably engaged with the recessed portion and the pointed portion of the first positioning groove, the bent portion of the other end of the elastic rib is fastened to the locking sleeve, the locking sleeve is mated with an elastic limiting ring, and the limiting ring is fitted on the elastic rib and the locking sleeve and fastens the elastic rib and the locking sleeve.

Preferably, an inner wall of the mounting end opening is provided with a fixing flange. An outer wall of the sliding sleeve is provided with a connecting flange. The connecting flange and the fixing flange are connected by a bolt.

Preferably, the inlet end opening is located at a top of the three-way member. The mounting end opening is disposed at one side of the three-way member.

Preferably, the linking member includes a wire tube, a wire, and a reversing drive mechanism. The reversing drive mechanism includes a reversing swing block, a guide sleeve, a piston, a push rod, and a return spring. The guide sleeve is fitted in the inlet end opening. The piston is movably disposed in the guide sleeve. The reversing swing block is rotatably fitted under the guide sleeve. An upper end of the push rod is inserted into the guide sleeve from a lower end of the guide sleeve and connected to the piston. A lower end of the push rod is movable to hold one side of the reversing swing block. The linking end of the operating lever is movable to hold another side of the reversing swing block. The lower end of the push rod is provided with a stopping piece extending outward. Two ends of the return spring lean against the lower end of the guide sleeve and an upper end surface of the stopping piece, respectively. The wire tube is fixed in the shower rod. A lower end of the wire tube is connected to an upper end of the guide sleeve. The wire is movably disposed in the wire tube. An upper end of the wire is connected to the valve core. A lower end of the wire is inserted in the guide sleeve from the upper end of the guide sleeve and connected to the piston.

Preferably, an upper end of the wire tube is connected with a fixing sleeve. An outer wall of the fixing sleeve is provided with a fixing flange connected to an inner wall of the shower rod. The fixing flange is formed with a water aperture. An outer wall of the guide sleeve is provided with an engaging member that is engaged with a circumferential edge of a lower end opening of the shower rod. The engaging member is provided with a water hole.

Preferably, the wire is a steel wire.

Preferably, the engaging member has a hinge portion extending downward, and the reversing swing block is hinged to the hinge portion.

Preferably, the valve core is a cylinder. A lower end of the valve core is movably inserted into the fixing sleeve and connected to the upper end of the wire.

Preferably, the upper end and the lower end of the wire are provided with fixing blocks, respectively. The lower end of the valve core is provided with a first engaging groove for engaging the fixing block at the upper end of the wire. The piston is provided with a second engaging groove for engaging the fixing block at the lower end of the wire.

With the above structure, by moving the operating lever of the operating mechanism, the present invention can drive the valve core to move and block the upper outlet or the lower outlet through the linking member, thereby switching the shower nozzle or the hand-held shower head to spray water. Since the operating mechanism is connected to the lower end of the shower rod, the present invention can facilitate the switching of spray mods for users of different heights.

DETAILED DESCRIPTION OF THE PREFERRED EMBODIMENTS

Figure 1:
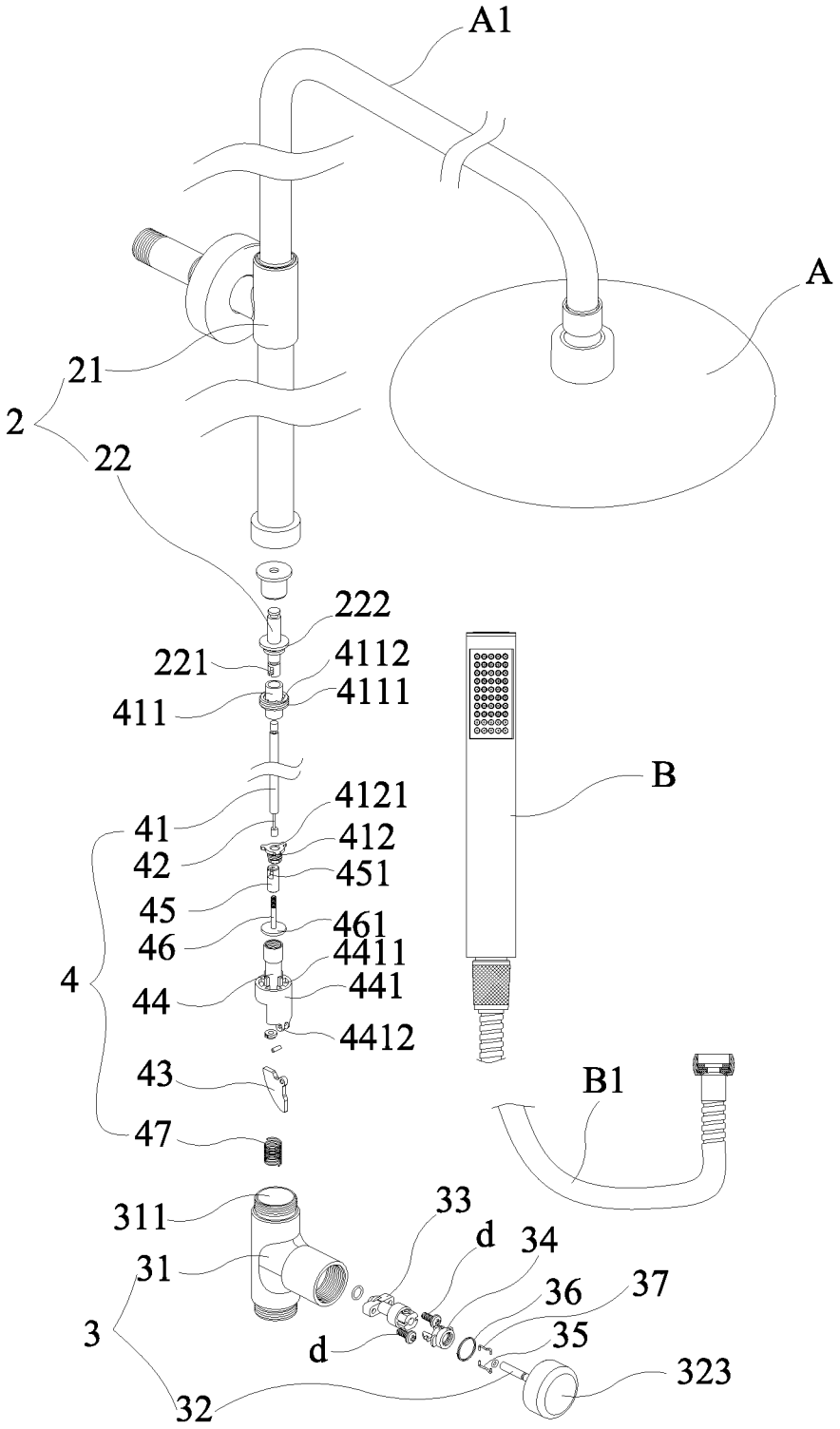
FIG. 1 is an exploded view of the present invention.

Embodiments of the present invention will now be described, by way of example only, with reference to the accompanying drawings.

As shown in FIG. 1 to FIG. 9, the present invention discloses a humanized control device applied to a health shower device, which is suitable for a wall-mounted shower device. The shower device comprises a shower nozzle A and a hand-held shower head B. The humanized control device comprises a shower rod 1, a water diverter 2, and an operating mechanism 3 for controlling the water diverter 2. The water diverter 2 includes a three way body 21 and a valve core 22. The three-way body 21 has a lateral inlet 211, an upper outlet 212, and a lower outlet 213. The valve core 22 is movably fitted in the three-way body 21 and is movable to block the upper outlet 212 and the lower outlet 213. The lateral inlet 211 is connected to the water outlet of a water supply pipe (not shown). The upper outlet 212 is connected to the shower nozzle A through a curved pipe A1. The shower rod 1 is a hollow structure. An upper end of the shower rod 1 is connected to the lower outlet 213 of the three way body 21 of the water diverter 2. A lower end of the shower rod 1 is connected to the operating mechanism 3. The operating mechanism 3 includes a three-way member 31 and an operating lever 32. The three-way member 31 has an inlet end opening 311, an outlet end opening 312, and a mounting end opening 313. The operating lever 32 is movably disposed in the mounting end opening 313. The inlet end opening 311 is connected to the lower end of the shower rod 1. The outlet end opening 312 is connected to the hand-held shower head B through a hose B1. Two ends of the operating lever 32 are a linking end 321 and an operating end 322, respectively. The linking end 321 of the operating lever 32 is linked with the valve core 22 through a linking member 4 located in the shower rod 1. Thus, by operating the operating lever 32, the water diverter 22 can be driven by the linking member 4 to move, thereby switching the shower nozzle A or the hand-held shower head B to spray water.

Figure 6:
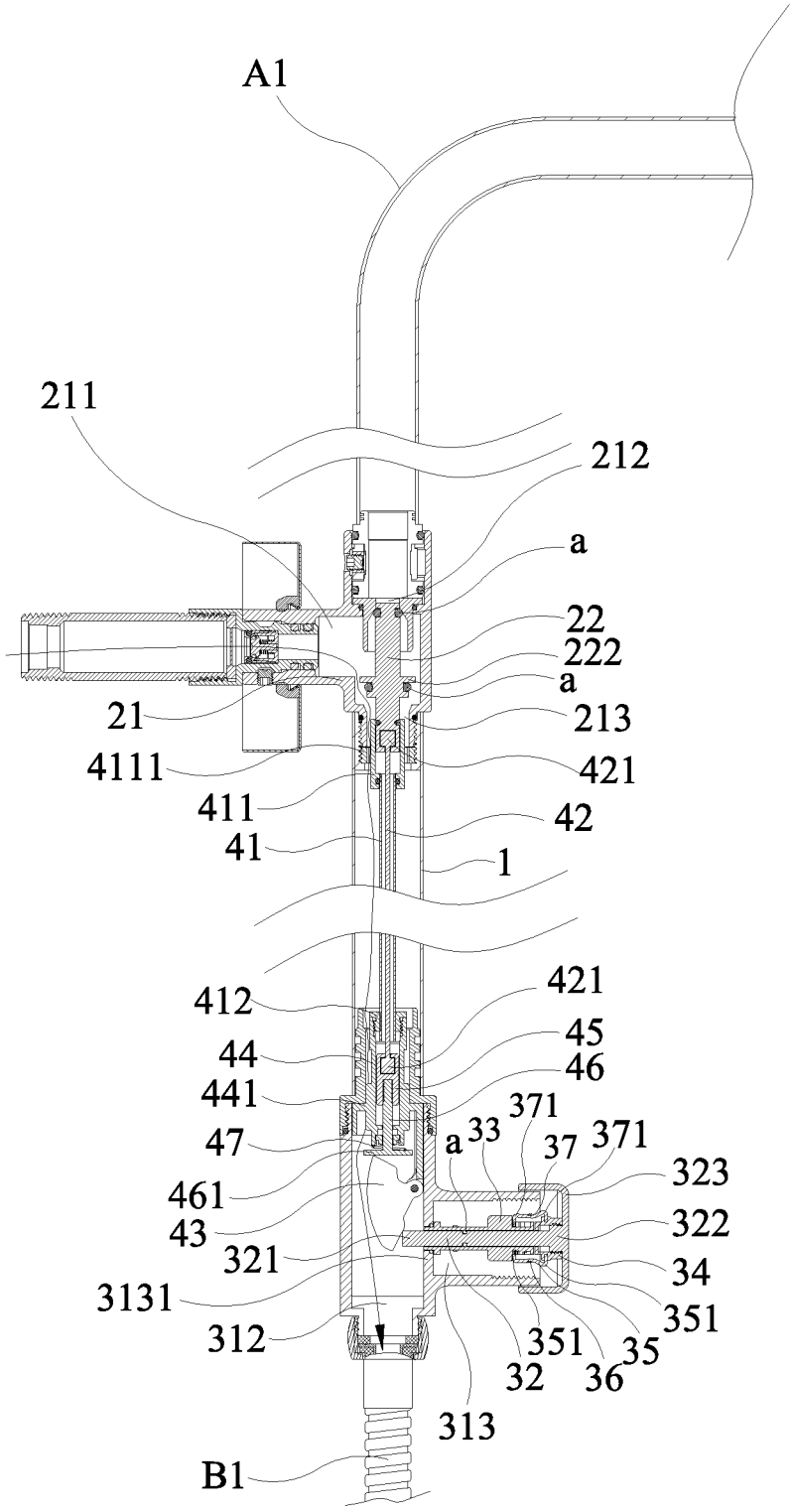
FIG. 6 is a cross-sectional view of the present invention when the hand-held shower head is selected to spray water.
Figure 7:
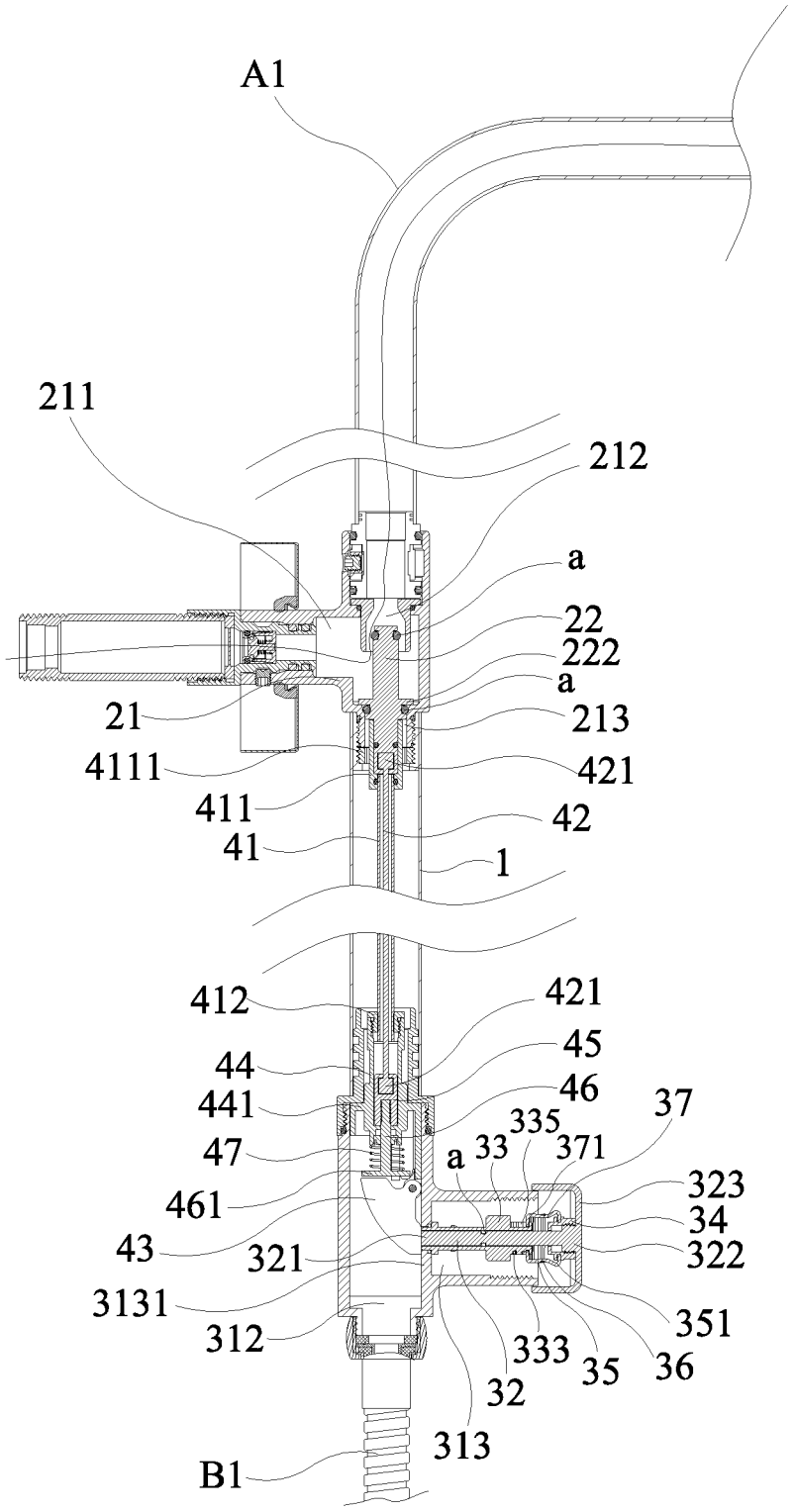
FIG. 7 is a cross-sectional view of the present invention when the shower nozzle is selected to spray water.

As shown in FIG. 1 and FIG. 6 and FIG. 7, the valve core 22 is a cylinder. The upper portion and the lower portion of the valve core 22 are moved to block the upper outlet 212 and the lower outlet 213, respectively. When valve core 22 is moved up, the upper portion of the valve core 22 blocks the upper outlet 212 and the lower portion of the valve core 22 does not block the lower outlet 213 so that the lower outlet 213 communicates with the lateral inlet 211. When the valve core 22 is moved down, the lower portion of the valve core 22 blocks the lower outlet 213 and the upper portion of the valve core 22 does not block the upper outlet 212 so that the upper outlet 212 communicates with the lateral inlet 211. In order to ensure that the valve core 22 can completely block the upper outlet 212 and the lower outlet 213, the upper portion and the lower portion of the valve core 22 are mated with sealing members a, respectively. In order to limit the maximum downward movement distance of the valve core 22, the central portion of the valve core 22 is provided with a limiting protrusion 222 that is movably engaged with the circumferential edge of the upper end of the lower outlet 213.

Figure 4:
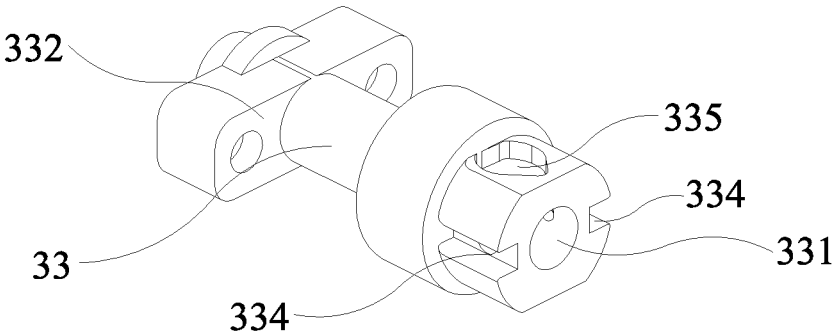
FIG. 4 is a second structural schematic view of the sliding sleeve of the present invention.
Figure 5:
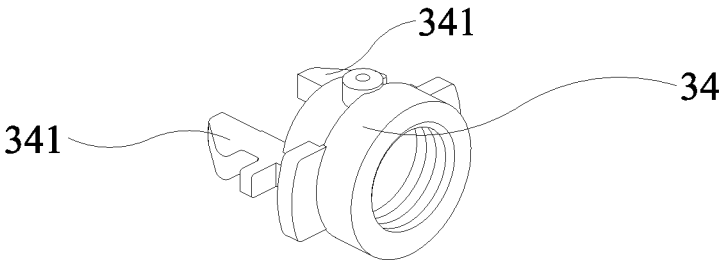
FIG. 5 is a structural schematic view of the locking sleeve of the present invention.

As shown in FIG. 1 and FIG. 4, the mounting end opening 313 is disposed at one side of the three-way member 31. The inlet end opening 311 is located at the top of the three-way member 31. The mounting end opening 313 is provided with a sliding sleeve 33 therein. The sliding sleeve 33 has a central through hole 331. The operating lever 32 is movably inserted in the through hole 331. The mounting end opening 313 has a fixing flange 3131 therein. The outer wall of the sliding sleeve 33 is provided with a connecting flange 332. The connecting flange 332 and the fixing flange 3131 are connected by a bolt d, and the sliding sleeve 33 is fitted in the mounting end opening 313. In order to prevent the water from leaking from the mounting end opening 313, a sealing ring a is provided between the connecting flange 332 and the fixing flange 3131, and another sealing ring a is provided between the operating lever 32 and the through hole 331.

As shown in FIG. 1 to FIG. 3 and FIG. 5 to FIG. 8, the side wall of the sliding sleeve 33 is formed with a first positioning groove 333 having a closed annular shape and a heart-shaped structure. The first positioning groove 333 has a recessed portion 33331 and a pointed portion 33311. The operating lever 32 is sleeved with a locking sleeve 34. The locking sleeve 34 is mated with a first positioning member 35. The end of the first positioning member 35 abuts against the bottom surface of the first positioning groove 333. The end of the first positioning member 35 is movably engaged with the recessed portion 33331 and the pointed portion 33311 of the first positioning groove 333. Through the first positioning groove 333, the operating lever 32 can be positioned at two positions. The pointed portion 33311 of the first positioning groove 33 is close to the operating end 321 of the operating lever 32. The locking sleeve 34 is fixed on the operating end 322 of the operating lever 32. The operating end 322 of the operating lever 32 is connected with a button 323 for the user to operate the operating lever 32. In order to prevent the end of the first positioning member 35 from being disengaged from the first positioning groove 333 by rotating the operating lever 32, the outer wall of the sliding sleeve 33 is provided with a limiting groove 334 along the axial direction of the through hole 331. The locking sleeve 34 is provided with a limiting block 341 that is inserted into the limiting slot 334 to restrict the rotation of the operating lever 32. As shown in FIG. 1, FIG. 6 and FIG. 7, the first positioning member 35 is an elastic rib. Two ends of the elastic rib are bent to form bent portions 351. The bent portion 351 of one end of the elastic rib abuts against the bottom surface of the first positioning groove 333 and is movably engaged with the recessed portion 33331 and the pointed portion 33311 of the first positioning groove 333. The bent portion 351 of the other end of the elastic rib is fastened to the locking sleeve 34. The locking sleeve 34 is mated with an elastic limiting ring 36. The limiting ring 36 may be a spring. The limiting ring 36 is fitted on the elastic rib and the locking sleeve 34 and fastens the elastic rib and the locking sleeve 34 to ensure that the bent portion 351 at one end of the elastic rib can be kept against the button surface of the first positioning groove 333 all the time.

As shown in FIG. 4, FIG. 6 and FIG. 7, the side wall of the sliding sleeve 33 is further formed with a second positioning groove 335 having a heart-shaped structure. The second positioning groove 335 and the first positioning groove 333 are opposite each other. An elastic positioning strip 37 is fitted on the locking sleeve 34. Two ends of the elastic positioning strip 37 are bent to form hooks 371. The hook 371 at one end of the elastic positioning strip 37 is movably fastened to the second positioning groove 335. The hook 371 at the other end of the elastic positioning strip 37 is fastened to the locking sleeve 34. The limiting ring 36 is fitted on the elastic rib, the elastic positioning strip 37 and the locking sleeve 34 and fastens the elastic rib, the elastic positioning strip 37 and the locking sleeve 34.

Figure 2:
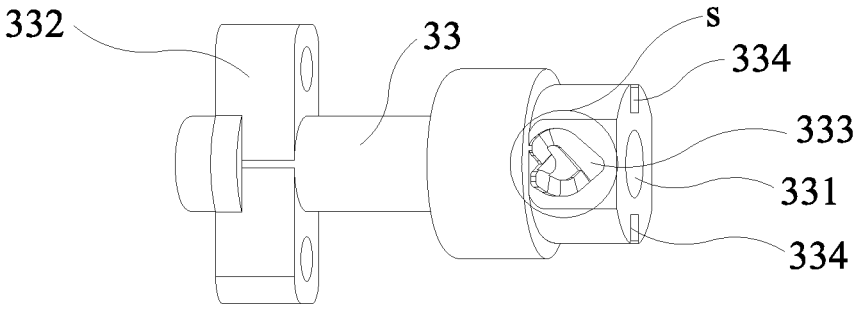
FIG. 2 is a first structural schematic view of the sliding sleeve of the present invention.
Figure 3:
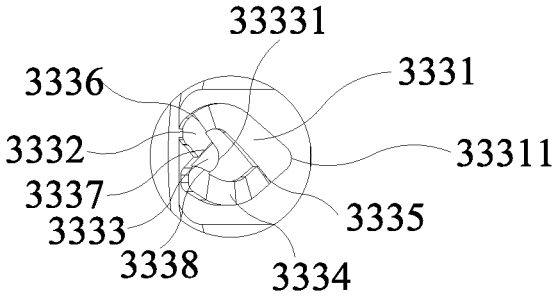
FIG. 3 is an enlarged view of FIG. 2.

As shown in FIG. 2 and FIG. 3, the first positioning groove 333 includes an ascending groove 3331, an entrance groove 3332, an exit groove 3333, and a descending groove 3334. The ascending groove 3331 is connected with the descending groove 3334 to form a V-shaped structure. The junction of the ascending groove 3331 and the descending groove 3334 forms a first stepped edge 3335. One side of the ascending groove 3331, adjacent to the first stepped edge 3335, is formed with the pointed portion 33311 of the first positioning groove 333. At the first stepped edge 3335, the depth of the ascending groove 3331 is greater than the depth of the descending groove 3334. The junction of the ascending groove 3331 and the entrance groove 3332 is formed with a second stepped edge 3336. At the second stepped edge 3336, the depth of the entrance groove 3332 is greater than the depth of the ascending groove 3331. The entrance groove 3332 is connected to the exit groove 3333 to form a V-shaped structure. The junction of the entrance groove 3332 and the exit groove 3333 is formed with a third stepped edge 3337. The recessed portion 33331 of the first positioning groove 333 is formed on the exit groove 333. At the third stepped edge 3337, the depth of the exit groove 3333 is greater than the depth of the entrance groove 3332. The junction of the exit groove 3333 and the descending groove 3334 is formed with a fourth stepped edge 3338. At the fourth stepped edge 3338, the depth of the descending groove 3334 is greater than the depth of the exit groove 3333. The depth of the ascending groove 3331 gradually reduces from the first stepped edge 3335 to the second stepped edge 3336. Since the end of the first positioning member 35 abuts against the bottom surface of the first positioning groove 333, the arrangement of the first step edge 3335, the second step edge 3336, the third step edge 3337 and the fourth step edge 3338 enables the end of the first positioning member 35 to move only in one direction along the ascending groove 3331, the entrance groove 3332, the exit groove 3333 and the descending groove 3334. For the end of the first positioning member 35 to move smoothly in the first positioning groove 333, the depth of the entrance groove 3332 gradually increases from the second step edge 3336 to the third step edge 3337. The depth of the exit groove 3333 gradually increases from the third stepped edge 3337 to the fourth stepped edge 3338. The depth of the descending groove 3334 gradually increases from the fourth stepped edge 3338 to the first stepped edge 3335.

As shown in FIG. 1, FIG. 6 and FIG. 7, the linking member 4 includes a wire tube 41, a wire 42, and a reversing drive mechanism. The wire tube 41 is fixed in the shower rod 1. The wire 42 is movably inserted in the wire tube 41. An upper end of the wire 42 is connected to the valve core 22. A lower end of the wire 42 is connected to the reversing drive mechanism. The reversing drive mechanism is linked with the operating lever 32.

As shown in FIG. 1, FIG. 6 and FIG. 7, the reversing drive mechanism includes a reversing swing block 43, a guide sleeve 44, a piston 45, a push rod 46, and a return spring 47. The guide sleeve 44 is fitted in the inlet end opening 311. The piston 45 is movably inserted into the guide sleeve 44. The reversing swing block 43 is rotatably fitted under the guide sleeve 44. The upper end of the push rod 46 is inserted into the guide sleeve 44 from the lower end of the guide sleeve 44 and is connected to the piston 45. The lower end of the push rod 46 is movable to hold one side of the reversing swing block 43. The linking end 321 of the operating lever 32 is movable to hold another side of the reversing swing block 43. The return spring 47 is disposed between the push rod 46 and the guide sleeve 44 for driving the push rod 46 to move downward. Moving the operating lever 32 to drive the reversing pendulum block 43 to rotate upward can push the push rod 46 and the push block 45 up and to compress the return spring 47. When the operating lever 32 is moved to loosen the holding action of the reversing swing block 43, the return spring 47 is returned to move the push rod 46 and the piston 45 downward. The outer wall of the guide sleeve 44 is provided with an engaging member 441 that is engaged with the circumferential edge of the lower end opening of the shower rod 1. The engaging member 441 is provided with a water hole 4411 for the passing of water. The engaging member 441 has a hinge portion 4412 extending downward. The reversing swing block 43 is hinged to the hinge portion 4412. The diameter of the piston 45 is greater than the diameter of the bottom opening of the guide sleeve 44 to confine the piston 45 within the guide sleeve 44. The push rod 46 is connected to the piston 45 by means of a screw connection. The lower end of the push rod 46 is provided with a stopping piece 461 extending outward. Two ends of the return spring 47 lean against the lower end of the guide sleeve 44 and the upper end surface of the stopping piece 461, respectively.

As shown in FIG. 1, FIG. 6 and FIG. 7, the upper end of the wire tube 41 is connected with a fixing sleeve 411. The outer wall of the fixing sleeve 411 is provided with a fixing flange 4111 connected to the inner wall of the shower rod 1. The fixing flange 4111 is formed with a water aperture 4112 for the passing of water. The lower end of the wire tube 41 is connected with a connecting sleeve 412. The connecting sleeve 412 is connected to the upper end opening of the guide sleeve 44. The upper and lower ends of the wire tube 41 can be fixed by the fixing sleeve 411 connected to the inner wall of the shower rod 1 and the guide sleeve 44 engaged with the circumferential edge of the lower end opening of the shower rod 1, respectively, so that the wire tube 41 is fixed in the shower rod 1 to form a limit on the wire 42 disposed in the wire tube 41. In this way, the up and down movement of the wire 42 can drive the valve core 22 to move up and down. As shown in FIG. 6 and FIG. 7, the fixing flange 4111 is connected to the inner wall of the shower rod 1 by a screw connection. The connecting sleeve 412 is connected to the upper end opening of the guide sleeve 44 by a screw connection. The fixing sleeve 411 and the connecting sleeve 412 are welded or glued to the upper and lower ends of the wire tube 41, respectively. The diameter of the central through hole 4121 of the connecting sleeve 412 is less than the diameter of the piston 45 to limit the piston 45 within the guide sleeve 44.

As shown in FIG. 1, FIG. 6 and FIG. 7, the lower end of the valve core 22 is movably disposed in the fixing sleeve 411 and connected to the upper end of the wire 42. The lower end of the wire 42 is inserted into the guide sleeve 44 from the upper end of the guide sleeve 44 and connected to the piston 45. The upper end and the lower end of the wire 42 are provided with fixing blocks 421, respectively. The lower end of the valve core 22 is provided with a first engaging groove 221 for engaging the fixing block 421 at the upper end of the wire 42. The piston 45 is provided with a second engaging groove 451 for engaging the fixing block 421 at the lower end of the wire 42. The wire 42 may be a steel wire for the wire 42 to have a certain flexibility, so that the wire 42 can push the valve core 22 to move up.

Figure 8:
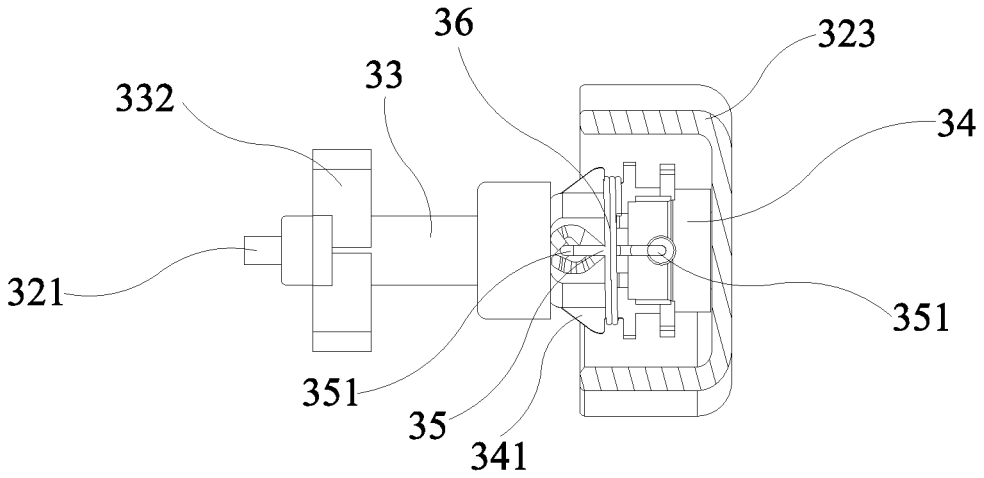
FIG. 8 is a schematic view showing the cooperation between the first positioning member and the first positioning groove of the present invention when the hand-held shower head is selected to spray water.

In order to facilitate the understanding of the present invention, the working process of the present invention is explained below:

As shown in FIG. 6 and FIG. 8, when the user selects the hand-held shower head B of the shower device of the present invention to spray water, the button 323 is pressed to move the operating lever 32 forward, and the linking end 321 of the operating lever 32 pushes the reversing swing block 43 to rotate upward. The reversing swing block 43 in turn pushes the push rod 46 and the piston 45 up to push the wire 42 up and to compress the return spring 47. The upward movement of the wire 42 pushes the valve core 22 up. The valve core 22 does not block the lower outlet 213 and the valve core 22 blocks the upper outlet 212, so that the lower outlet 213 communicates with the lateral inlet 211. At this time, the water from the water supply pipe enters the shower rod 1 via the lateral inlet 211 and the lower outlet 213, and then flows into the hand-held shower head B through the three-way member 31 and the hose B1, so that the hand-held shower head B sprays water, and the shower nozzle A does not spray water. In the process of the forward movement of the operating lever 32, the operating lever 32 will drive the end of the first positioning member 35 to move from the ascending groove slot 3331 to the entrance groove 3332. At this time, the button 323 is released, and the return spring 47 is returned to drive the push rod 46, the piston 45, the wire 42 and the valve core 22 to move down. The downward movement of the push rod 46 pushes the reversing swing block 43 to rotate downward to push the operating lever 32 to move reversely, so that the operating lever 32 drives the end of the first positioning member 35 to move from the entrance groove 3332 to the exit groove 3333, and the end of the first positioning member 35 is engaged with the recessed portion 33331 of the first positioning groove 333 to limit the operating lever 32. The return spring 47 is no longer returned, so that the valve core 22 is no longer moved downward. At this time, the valve core 22 still does not block the lower outlet 213 and the valve core 22 blocks the upper outlet 212, so that the lower outlet 213 is in communication with the lateral inlet 211. In this way, the present invention maintains the hand-held shower head B to spray water.

Figure 9:
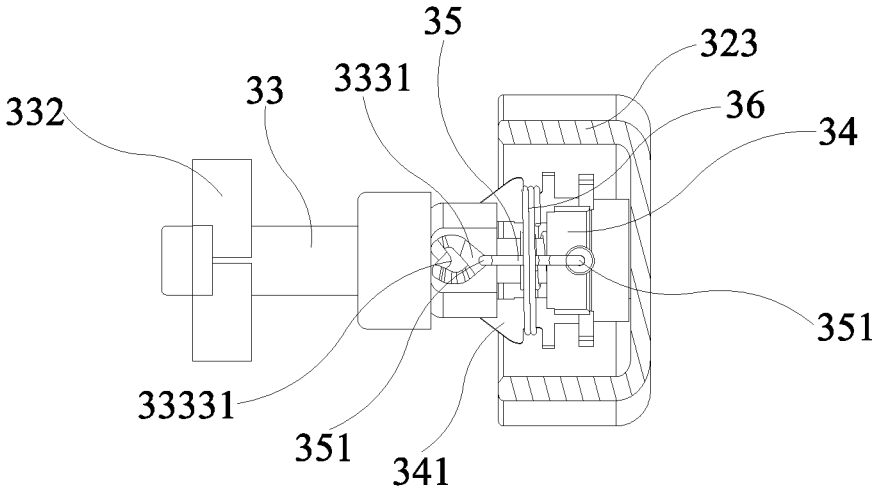
FIG. 9 is a schematic view showing the cooperation between the first positioning member and the first positioning groove of the present invention when the shower nozzle is selected to spray water.

As shown in FIG. 7 and FIG. 9, when the user selects the shower nozzle A of the shower device of the present invention to spray water, the button 323 is pressed to move the operating lever 32 forward, and the operating lever 32 drives the end of the first positioning member 35 to move from the exit groove 3333 to the descending groove 3334. At this time, the button 323 is released, and the operating lever 32 is no longer restricted. The return spring 47 is returned to drive the push rod 46, the piston 45, the wire 42 and the valve core 22 to move downward, and the downward movement of the push rod 46 pushes the reversing swing block 43 downward to push the operating lever 32 to move reversely. In turn, the operating lever 32 drives the end of the first positioning member 35 to move from the descending groove 3334 to the ascending groove 3331. When the end of the first positioning member 35 is moved to engage the pointed portion 33311 in the ascending groove 3331, the valve core 22 is moved down. The valve core 22 does not block the upper outlet 212 and the valve core 22 blocks the lower outlet 213, so that the upper outlet 212 communicates with the lateral inlet 211. The water from the water supply pipe enters the shower nozzle A through the lateral inlet 211 and the upper outlet 212, so that the shower nozzle A sprays water, and the hand-held shower head B does not spray water.

In summary, by moving the operating lever 32 of the operating mechanism 3, the present invention can drive the valve core 22 to move and block the upper outlet 212 or the lower outlet 213 through the linking member 4, thereby switching the shower nozzle A or the hand-held shower head B to spray water. Since the operating mechanism 3 is connected to the lower end of the shower rod 1, the present invention can facilitate the switching of spray mods for users of different heights.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A humanized control device applied to a health shower device, comprising a shower rod, a water diverter, and an operating mechanism;

the water diverter including a three-way body and a valve core, the three-way body having a lateral inlet, an upper outlet and a lower outlet, the valve core being movably fitted in the three-way body to block the upper outlet and the lower outlet;

the shower rod being a hollow structure, an upper end of the shower rod being connected to the lower outlet of the three-way body;

the operating mechanism including a three-way member and an operating lever, the three-way member having an inlet end opening, an outlet end opening and a mounting end opening, the operating lever being movably disposed in the mounting end opening, the inlet end opening being connected to a lower end of the shower rod; two ends of the operating lever being a linking end and an operating end respectively, the linking end of the operating lever being linked with the valve core through a linking member located in the shower rod.

2. The humanized control device as claimed in claim 1, wherein the mounting end opening is provided with a sliding sleeve therein, the sliding sleeve has a central through hole, and the operating lever is movably inserted in the through hole.

3. The humanized control device as claimed in claim 2, wherein a side wall of the sliding sleeve is formed with a first positioning groove having a closed annular shape and a heart-shaped structure, the first positioning groove has a recessed portion and a pointed portion;

the operating lever is sleeved with a locking sleeve, the locking sleeve is mated with a first positioning member, an end of the first positioning member abuts against a bottom surface of the first positioning groove, and the end of the first positioning member is movably engaged with the recessed portion and the pointed portion of the first positioning groove.

4. The humanized control device as claimed in claim 3, wherein the pointed portion of the first positioning groove is close to the operating end of the operating lever, the locking sleeve is fixed on the operating end of the operating lever, and the operating end of the operating lever is connected with a button.

5. The humanized control device as claimed in claim 3, wherein the first positioning member is an elastic rib, two ends of the elastic rib are bent to form bent portions, the bent portion of one end of the elastic rib abuts against the bottom surface of the first positioning groove and is movably engaged with the recessed portion and the pointed portion of the first positioning groove, the bent portion of the other end of the elastic rib is fastened to the locking sleeve, the locking sleeve is mated with an elastic limiting ring, and the limiting ring is fitted on the elastic rib and the locking sleeve and fastens the elastic rib and the locking sleeve.

6. The humanized control device as claimed in claim 2, wherein an inner wall of the mounting end opening is provided with a fixing flange, an outer wall of the sliding sleeve is provided with a connecting flange, the connecting flange and the fixing flange are connected by a bolt.

7. The humanized control device as claimed in claim 1, wherein the inlet end opening is located at a top of the three-way member, and the mounting end opening is disposed at one side of the three-way member.

8. The humanized control device as claimed in claim 7, wherein the linking member includes a wire tube, a wire, and a reversing drive mechanism; the reversing drive mechanism includes a reversing swing block, a guide sleeve, a piston, a push rod, and a return spring; the guide sleeve is fitted in the inlet end opening, the piston is movably disposed in the guide sleeve, the reversing swing block is rotatably fitted under the guide sleeve, an upper end of the push rod is inserted into the guide sleeve from a lower end of the guide sleeve and connected to the piston, a lower end of the push rod is movable to hold one side of the reversing swing block, the linking end of the operating lever is movable to hold another side of the reversing swing block; the lower end of the push rod is provided with a stopping piece extending outward, two ends of the return spring lean against the lower end of the guide sleeve and an upper end surface of the stopping piece respectively;

the wire tube is fixed in the shower rod, a lower end of the wire tube is connected to an upper end of the guide sleeve;

the wire is movably disposed in the wire tube, an upper end of the wire is connected to the valve core, and a lower end of the wire is inserted in the guide sleeve from the upper end of the guide sleeve and connected to the piston.

9. The humanized control device as claimed in claim 8, wherein an upper end of the wire tube is connected with a fixing sleeve, an outer wall of the fixing sleeve is provided with a fixing flange connected to an inner wall of the shower rod, the fixing flange is formed with a water aperture; an outer wall of the guide sleeve is provided with an engaging member that is engaged with a circumferential edge of a lower end opening of the shower rod, and the engaging member is provided with a water hole.

10. The humanized control device as claimed in claim 9, wherein the wire is a steel wire.

11. The humanized control device as claimed in claim 9, wherein the engaging member has a hinge portion extending downward, and the reversing swing block is hinged to the hinge portion.

12. The humanized control device as claimed in claim 9, wherein the valve core is a cylinder, and a lower end of the valve core is movably inserted into the fixing sleeve and connected to the upper end of the wire.

13. The humanized control device as claimed in claim 12, wherein the upper end and the lower end of the wire are provided with fixing blocks respectively, the lower end of the valve core is provided with a first engaging groove for engaging the fixing block at the upper end of the wire, and the piston is provided with a second engaging groove for engaging the fixing block at the lower end of the wire.

* * * * *